US011378078B2

(12) United States Patent
Dicks et al.

(10) Patent No.: US 11,378,078 B2
(45) Date of Patent: Jul. 5, 2022

(54) ECCENTRIC SCREW PUMP WITH TELESCOPING HOUSING

(71) Applicant: SEEPEX GmbH, Bottrop (DE)

(72) Inventors: Norman Dicks, Geldern (DE); Stefan Goethel, Bochum (DE); Marcel Griesdorn, Bottrop (DE); Peter McGarian, Tintinhull (GB); Dirk Overmeier, Oberhausen (DE); Vsevolod Ryvkin, Essen (DE)

(73) Assignee: SEEPEX GMBH, Bottrop (DE)

( * ) Notice: Subject to any disclaimer, the term of this patent is extended or adjusted under 35 U.S.C. 154(b) by 365 days.

(21) Appl. No.: 16/343,230

(22) PCT Filed: Nov. 9, 2017

(86) PCT No.: PCT/EP2017/078800
§ 371 (c)(1),
(2) Date: Apr. 18, 2019

(87) PCT Pub. No.: WO2018/087248
PCT Pub. Date: May 17, 2018

(65) Prior Publication Data

US 2019/0316583 A1 Oct. 17, 2019

(30) Foreign Application Priority Data

Nov. 10, 2016 (DE) ..... 102016121582.1

(51) Int. Cl.
*F04C 15/00* (2006.01)
*F04C 2/107* (2006.01)
*F04C 11/00* (2006.01)

(52) U.S. Cl.
CPC ..... *F04C 15/0061* (2013.01); *F04C 2/1073* (2013.01); *F04C 11/006* (2013.01);
(Continued)

(58) Field of Classification Search
CPC ..... F04C 15/0061; F04C 2/1073; F04C 2240/30; F04C 2230/80; F04C 2230/85;
(Continued)

(56) References Cited

U.S. PATENT DOCUMENTS 3,011,445 A * 12/1961 Bourke ..... F04C 14/26 417/440
3,838,949 A * 10/1974 Makino ..... F04C 2/1073 418/48

(Continued)

OTHER PUBLICATIONS

International Search Report of WO2018087248A1 (this is the International Application associated with Applicants' disclosure) (Year: 2018).*

*Primary Examiner* — Dominick L Plakkoottam
*Assistant Examiner* — Paul W Thiede
(74) *Attorney, Agent, or Firm* — Andrew Wilford

(57) ABSTRACT

What is concerned is an eccentric screw pump having at least one stator (1), a rotor (2) rotating in the stator, a drive (3) for the rotor, a pump housing (4) which is connected to the stator (1) and has at least one inlet opening (6) for the medium to be conveyed, a connection housing (14) arranged between the pump housing (4) and drive (3), a connection shaft (9) which is connected to the drive (3) and is arranged at least in certain regions in the connection housing (14), and a coupling rod (10) which is arranged in the pump housing (4) and is connected to the connection shaft (9) via a drive-side joint (11) and to the rotor (2) via a rotor-side joint (12). The drive-side housing connection piece (16) can be demounted in such a way that the drive-side joint (11) can be exposed for maintenance or demounting.

14 Claims, 12 Drawing Sheets

(52) U.S. Cl.
CPC ..... *F04C 2230/60* (2013.01); *F04C 2230/80* (2013.01); *F04C 2230/85* (2013.01); *F04C 2240/30* (2013.01)

(58) Field of Classification Search
CPC .. F04C 2230/60; F04C 11/006; F04C 2/1071; F04C 14/26; F01C 2/007
See application file for complete search history.

(56) References Cited

U.S. PATENT DOCUMENTS

| | | | | |
|---|---|---|---|---|
| 5,474,432 | A * | 12/1995 | Hulley | F04C 2/1075 418/48 |
| 5,688,114 | A | 11/1997 | Millington | |
| 9,777,728 | B2 | 10/2017 | Thomas | |
| 10,648,337 | B2 * | 5/2020 | Overmeier | F01C 21/007 |
| 2003/0003000 | A1 * | 1/2003 | Shepherd | F04C 2/1073 417/410.3 |
| 2013/0283563 | A1 * | 10/2013 | Fry | B01D 46/0075 15/347 |
| 2016/0245285 | A1 | 8/2016 | Tanito | |
| 2019/0283981 | A1 * | 9/2019 | Rickers | F04C 2/1073 |

* cited by examiner

ECCENTRIC SCREW PUMP WITH TELESCOPING HOUSING

CROSS REFERENCE TO RELATED APPLICATIONS

This application is the US-national stage of PCT application PCT/EP2017/078800 filed 9 Nov. 2017 and claiming the priority of German patent application 102016121582.1 itself filed 10 Nov. 2016.

FIELD OF THE INVENTION

The invention relates to an eccentric screw pump.

BACKGROUND OF THE INVENTION

An eccentric screw pump typically has at least a stator, a rotor rotatable in the stator, a drive for the rotor, a pump housing (for example an intake housing) connected with the stator (for example on the intake side) and having at least one housing port, for example an intake port (or output port) for the medium to be conveyed, a drive-connection housing provided between pump housing and drive, a drive shaft connected with the drive and provided in the drive-connection housing, at least in certain regions, and a coupling rod provided in the pump housing and connected with the drive shaft by a drive-side coupling and with the rotor by a rotor-side coupling, where the pump housing has a drive-side housing connector (for example a tubular connector) connected with the drive-connection housing, the pump housing has a stator-side housing connector (for example a tubular housing connector) connected with the stator. The housing port, for example the intake port of the pump housing (which can also function as an output port) is preferably provided between the drive-side connector and the stator-side connector.

Such an eccentric screw pump is a pump from the group of rotating displacement pumps used for conveying the most varied media and, in particular, high-viscosity liquids, in the most varied industrial sectors. In this regard, the liquids to be conveyed for example can also contain solid components.

The stator consists, for example, of elastic or elastomeric material and is generally surrounded by a one-piece or multi-piece stator mantle or housing. Alternatively, however, stators made of other material, for example of metal, are also included. The pump housing connected with the stator on the intake side is generally referred to as an intake housing, and the housing connected with the stator on the output side is referred to for example as a pressure connector. Basically, however, the possibility also exists of operating such a pump in the opposite conveying direction, so that the intake housing (as the pump housing) would then be provided on the output side. The designation of the pump housing or intake housing consequently takes place, according to the invention, independent of the actual conveying direction. The rotating connection that simultaneously guarantees eccentricity between the drive or the drive shaft on the one hand and the rotor on the other hand is the coupling rod provided in the pump housing. The drive acts on the coupling rod through the drive shaft. In this regard, the drive shaft can be formed directly by the drive shaft of the drive.

Preferably, however, the drive shaft is separate from the drive and can be a stub shaft and serve as a connector between drive shaft and the force transfer parts of the pump, so to speak. The drive-connection housing provided between the pump housing (for example intake housing) and the drive is also referred to as a "lantern" in practice. This serves for "holding" or attaching and supporting the pump housing on the one hand and the drive on the other hand so that this drive-connection housing or the lantern is attached on a base or directly on a foundation and supports or carries the drive and the pump housing. The drive can be an electric motor drive or as a hydraulic drive.

Preferably, the eccentric screw pump is a funnel pump, and the intake port of the pump housing is an inflow funnel. Preferably, the coupling rod provided below the inflow funnel, for example, is provided with at least one transport device, for example an auger or similar transport elements. Such an auger can for example be welded around the outer surface of the coupling rod.

Maintenance and repair of a pump have particular importance in practice, in particular since different parts are subject to significant wear in some cases and therefore must be exchanged and replaced as wear parts if necessary. For example, replacement of the stator and of the rotor, if necessary, has particular significance. Since the rotor is generally connected with the coupling rod by a rotor-side coupling, it is generally necessary to open up this coupling during replacement, so that accessibility of the rotor-side coupling is of particular significance.

Against this background, the possibility of exposing the region of the rotor-side coupling of the coupling rod is described in WO 2010/012993 [U.S. Pat. No. 9,777,728], in that the stator-side or rotor-side housing connector of the pump housing is structured so that it can be taken apart. For this purpose, a section of this housing connector can be released from the pump housing and pushed toward the stator in the axial or axis-parallel direction, so that the rotor-side region of the coupling rod is exposed.

OBJECT OF THE INVENTION

Proceeding from the previously known state of the art, the object of the invention is to create an eccentric screw pump of the type described above, which pump is characterized by optimized maintenance and repair possibilities, while having a simple structure.

SUMMARY OF THE INVENTION

To accomplish this task, the invention teaches, in the case of a type-specific eccentric screw pump of the type described initially, that the housing connector on the drive side can be disassembled (or dismantled) in such a manner that the drive-side coupling can be exposed for maintenance or disassembly. In this regard, the drive-side housing connector is preferably configured in such a manner that the drive-side coupling can be exposed in such a manner that it is no longer surrounded by the drive-side housing connector and is fully exposed (at least in the coupling region or in the plane of the coupling). Preferably, exposure of the drive-side coupling takes place in such a manner that the drive-side coupling is fully exposed (in the coupling region).

In this regard, the invention proceeds from the recognition that maintenance and repair possibilities of an eccentric screw pump of the type described can be optimized if (simple) dismantling or disassembly of the pump housing is made possible on the drive side, in that the drive-side housing connector, which can be tubular for example and in which the drive-side coupling is provided, is structured so that it can be disassembled or dismantled. The measures known from the state of the art, which relate to the stator-side region, are transferred to the drive-side region according to the invention. According to the invention, the possibility then exists of exposing the drive-side coupling by disassembly in the region of the drive-side housing connector of the pump housing, so that the drive-side coupling can for example subsequently be dismantled. In this way, the coupling rod can be separated from the drive shaft or coupling shaft so that subsequent replacement of the shaft seal (for example a slide ring seal) and/or of the drive shaft (for example stub shaft) in particular is possible, specifically without the pump housing or the drive as a whole having to be disassembled. Instead, locally very limited disassembly of the pump housing in the region of the drive-side housing connector of the pump housing is sufficient. In this regard, it lies within the scope of the invention that disassembly of the drive-side housing connector or exposure of the coupling takes place in such a manner that the drive-side coupling is no longer surrounded by the drive-side housing connector and is fully exposed.

This can for example be implemented in that the drive-side housing connector is formed at least in certain regions by multiple half-shells or partial shells, for example by an upper half-shell and a lower half-shell, so that then one of the half-shells can for example be removed so as to expose the drive-side coupling. If only one of the half-shells is removed, then the drive-side coupling is fully exposed after removal of this half-shell, but rather only half exposed, for example. However, it is particularly preferably provided that exposure of the coupling takes place in such a manner that the drive-side coupling (in the coupling region) is fully exposed. This can be implemented, for example, in that both an upper half-shell and a lower half-shell are removed, so that the coupling is completely exposed and is no longer surrounded. Particularly preferably, exposure of the drive-side coupling takes place by displacement of a connector section in the axial or axis-parallel direction. For this purpose, the drive-side housing connector can have a (locally) fixed section on the one hand and a second (tubular) section on the other hand which latter section is displaceable axially relative to the first section, specifically particularly preferably toward the intake port onto the first section. The possibility exists that the second section can be pushed onto the first section. Alternatively, the second section can be pushed into the first section. The invention basically includes the possibility that such a displaceable housing or such a displaceable (tubular) section is pushed away from the pump housing and consequently toward the drive or of the drive-connection housing (lantern). Particularly preferably, however, displacement takes place in the direction toward the pump housing (or onto the pump housing).

According to a further proposal of the invention, it is optionally provided that the drive-connection housing (also referred to as a lantern) is pivotal about a vertical axis of rotation with reference to the base of the pump. This means that in the case of a locally fixed, mounted state of the pump housing, and merely a disassembled or opened drive-side housing connector, rotation of the drive-connection housing and consequently of the lantern on the base plane of the pump is possible. These measures allow particularly easy disassembly of the drive shaft or of the stub shaft provided within the drive-connection housing. This is because the interior of the drive-connection housing becomes accessible from the side by rotation about a vertical axis (with reference to the base plane of the pump), so that the drive shaft (stub shaft) can be pulled out of the drive-connection housing, specifically without any disassembly (or removal) of the drive-connection housing being required. Instead, it is sufficient to first open or disassemble the drive-side housing connector in the manner according to the invention, and subsequently rotate the drive-connection housing. Such a "pivotable" lantern optionally consequently has particular importance within the scope of the invention.

According to a further proposal of the invention, it is optionally provided that the drive-side housing connector has a (locally) fixed first section (on the one hand) and a second support section (on the other hand), and the second section can be axially pushed onto the first section axially toward the intake port. This possibility, as has already been described, relates to the drive-side housing connector, so that the drive-side coupling can be exposed and subsequently the lantern is pivotal, for example.

Preferably, it is provided that the (tubular) second section and the (tubular) first section are configured cylindrically or essentially cylindrically, at least in certain regions in each instance. In this regard, it is advantageous if the inside diameter of the second movable section is greater (at least in certain regions) than the outside diameter of the fixed first section. This particularly holds true if the second section can be pushed onto the first section. If the second section can be pushed into the first section, it is practical if the outside diameter of the second section is smaller than the inside diameter of the first section. In the assembled state, of course, a suitable seal is provided between the first section and the second section, so that the pump housing as a whole is configured to be liquid- and pressure-tight. For this purpose, the fixed first section can be provided with a circumferential seal, for example an O-ring, on the outer surface. Alternatively or in addition the second movable section can be provided with a circumferential seal, for example an O-ring, on the inner surface. It is understood that the respective opposite part has complementary sealing surfaces, if necessary, against which the seal lies. If the second section is pushed into the first section, it is practical if the first section is provided with a circumferential seal, for example an O-ring, on the inner surface, or that alternatively the second movable section is provided with a circumferential seal, for example an O-ring, on the outer surface.

According to a further proposal of the invention, the coupling rod with transport device, for example an auger, if necessary, is supported to prevent it from dropping or falling out and/or to prevent (axial) displacement during disassembly of the drive-side housing connector. In this way, the possibility exists of fixing the coupling rod (or conveying screw) in place before the drive-side coupling is disconnected for service purposes. In this manner, disassembly of the couplings can be facilitated. Separate fixation and positioning by a crane or the like is not necessary. This is because it must be taken into consideration that the coupling rod can have a great weight in practice, in particular in the embodiment with a conveying screw. In this way, the risk of injury during work on the coupling can also be reduced. Furthermore, sealing of the intake space can be achieved at the same time by such support or fixation, so that the space around the coupling, for example, can be cleaned without liquid getting into the pump housing. This will be discussed further below.

In one embodiment, the coupling rod is supported by the second movable section, for example by a connection-piece end wall of the second section. The second movable section can consequently be equipped on the end with an end wall that preferably has a (central) hole. In the assembled state, the drive shaft for example passes through this hole. During disassembly, the second section is displaced in the direction toward the first section, for example pushed onto it or pushed into it. In this regard, the relative dimensions are such that the coupling rod fits in the hole of the connector wall in the pushed-in state of the second section, in such a manner that this connector wall or the hole fixes the coupling rod in place or supports it to prevent lowering and/or to prevent axial displacement. In this regard, the hole can fit to the outer surface of the coupling rod in such a manner that in the pushed-in state a seal is formed, specifically by the connection-piece end wall of the second movable section.

In a modified embodiment, support of the coupling rod during disassembly is formed by a partition wall provided in the drive-side housing connector. Such a partition wall can separate a drive-side chamber (formed for example by the displaceable section) from the interior of the pump housing. This partition wall can have a hole through which the coupling rod passes so that for example the coupling rod at least during disassembly of the drive-side housing coupling piece is supported in the hole. In this manner, as well, the space around the drive-side coupling can consequently be separated from the interior of the pump housing (for example the intake space) for cleaning purposes. In this embodiment, as well, the possibility exists that at the same time, sealing of the coupling rod in the hole is implemented, so as to seal the drive-side chamber relative to the interior of the pump housing in this manner. For this purpose, the coupling rod can be supported in the hole with the interposition of a seal. Consequently, a sealing element can be integrated into the hole in the partition wall.

A partition wall in the drive-side housing connector and that for example separates a drive-side chamber from the interior of the pump housing can furthermore be advantageous even independent of the problem of support of the coupling rod so that this aspect of the described partition wall is placed under protection even independent of support of the coupling rod or even without the possibility of support of the coupling rod. This is because such a partition wall also, in particular, makes penetration of conveying medium into the (drive-side) separate region more difficult, i.e. passage of conveying medium out of the pump housing into the separate, drive-side chamber is impeded.

Optionally, the second section, for example the drive-side chamber, is provided with one or more flush fittings, so that this drive-side chamber in which the exposed coupling is situated during disassembly can be flushed for cleaning purposes without the flushing liquid getting into the intake space. Also in connection with such flushing, the use of the partition wall described can consequently be advantageous, since it can be even better prevented using the partition wall that possible residues of a conveying medium block displacement of the housing part or make it more difficult.

Support of the coupling rod during disassembly is furthermore possible not only in the case of embodiments having second movable sections, but rather also in the case of other housing designs with exposure of the coupling region, for example also in the case of solutions with one or more half-shells that form the drive-side housing connector or are connected with the drive-side housing connector. For example, the possibility exists that the drive-side housing connector has a first fixed section that is connected to a second movable section and that has for example one or more removable partial shells, being formed by two half-shells. In such an embodiment, a partition wall for example can be provided in the fixed first section, and it in turn can be provided with a hole through which the coupling rod is passed, so that the coupling rod is supported in this hole during disassembly. In the manner already described, a seal can also be provided in the region of this hole.

Furthermore, the possibility also basically exists of installing separate holding components to support the coupling rod in the course of assembly. In any case, support or fixation of the coupling rod or conveying screw preferably takes place in that the drive-side end of the coupling rod or conveying screw interacts with a corresponding counterpart (for example the hole in the partition wall), so that displacement (in the axial direction) and/or lowering of the coupling rod (and thereby of the entire rotating unit) is prevented. This counterpart can be integrated into a displaceable component or a partition wall in the manner described or as an additional component, that can be attached after disassembly or displacement of the covering components. This connection between the coupling rod and the corresponding counterpart can furthermore be utilized in the manner described, so as to seal the gap between coupling rod and housing.

The drive-connection housing already mentioned is attached in basically known manner to a base plate or a foundation, so that it supports or carries the drive as well as the pump housing. Preferably, this attachment to the base plate or to the foundation can be released for pivoting of the drive-connection housing. For this purpose, the possibility also exists that the drive-connection housing is attached to the base plate and the foundation with multiple screws (or similar connections), and that only some of these connections are removed so that subsequently, pivoting about an axis of rotation can take place, which axis is formed by one of the (loosened) screws. In this regard, the decisive factor is the fact that such pivoting is possible, according to the invention, without the pump housing being completely removed. Instead, it is sufficient to disassemble or dismantle the pump housing in the region of the drive-side housing connector in the manner described in that the second section of the drive-side housing connector is for example displaced.

BRIEF DESCRIPTION OF THE DRAWING

In the following, the invention will be explained in greater detail with reference a drawing that merely represents an embodiment. In the drawing.

SPECIFIC DESCRIPTION OF THE INVENTION

Figure 1:
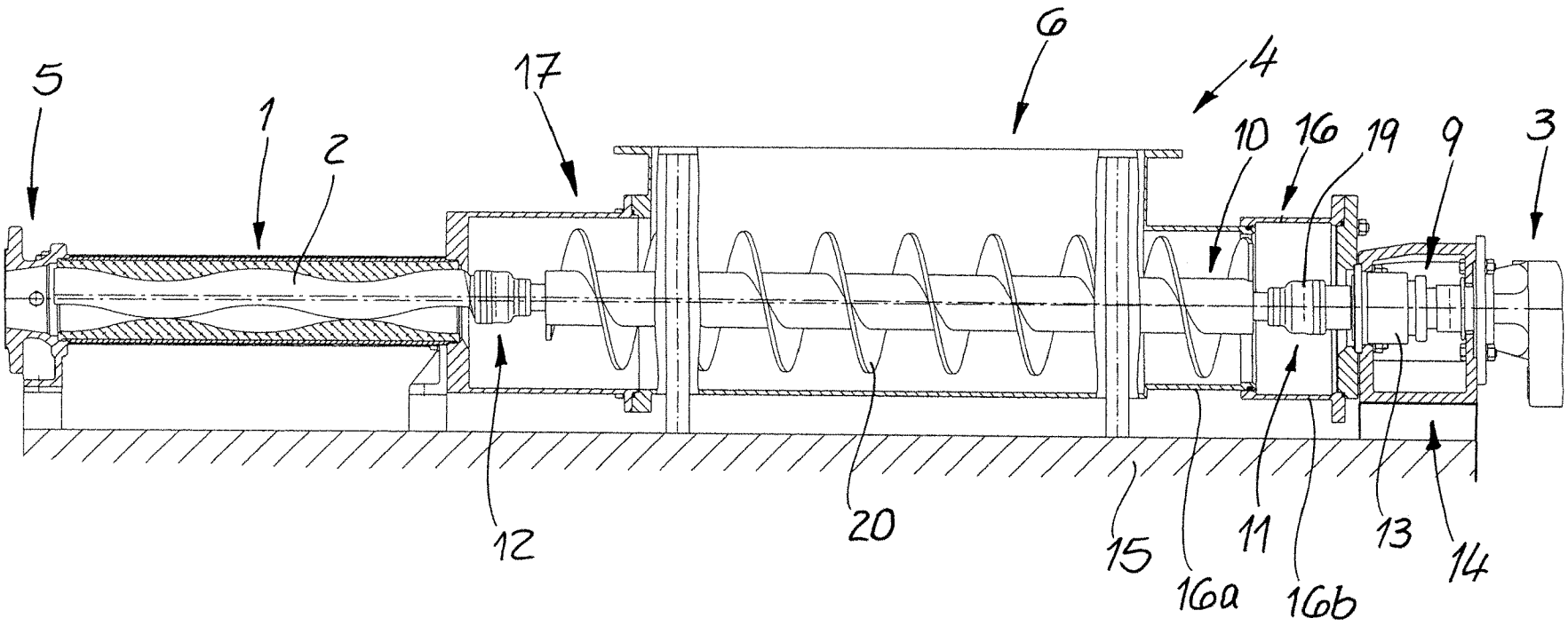
FIG. 1 is a vertical section through an eccentric screw pump according to the invention.

In the drawing, an eccentric screw pump basically has a stator 1, a rotor 2 rotatable in the stator 1, and a drive 3 for the rotor 2. A pump or intake housing 4 is connected with the stator 1 on the intake side, for example. A housing or so-called pressure connection part or piece 5 is connected with the stator on the output side. The pump housing 4 has an intake port 6 through which the medium to be conveyed is supplied; this medium is conveyed to the pressure connector 5 from the pump housing 4 through the stator/rotor. The drive 3 is equipped with an (unillustrated) integrated drive shaft that is connected with a drive shaft 9. This drive shaft 9 is a stub shaft in this embodiment. The rotor 2 is connected with the drive shaft 9 by a coupling rod 10 that is connected with the drive shaft 9 by a drive-side coupling 11 and with the rotor 2 by a rotor-side coupling 12. For liquid-tight separation of the pump housing 4 relative to the surroundings or relative to the drive, the drive shaft 9 is sealed by a shaft seal 13. This shaft seal 13 is for example a slide ring seal. No details are shown in the drawing.

A drive-connection housing 14 or so-called lantern is provided between the pump housing 4 and the drive 3. Such a drive-connection housing 14 is connected to the pump housing 4 at one end and to the drive 3 on the other end and supports them. In this regard, the drive-connection housing 14 can be attached to a base 15. The shaft seal 13 is connected with this drive-connection housing 14.

In the embodiment shown in FIGS. 1 to 7, the eccentric screw pump is a funnel pump. The intake port 6 is a funnel. The coupling rod 10 is provided with an auger 20 welded for example onto the outer surface of coupling rod 10.

The pump housing 4 has a drive-side tubular connector 16 connected to the drive-connection housing 14, and the drive-side coupling 11 is provided in this drive-side housing connector 16.

Furthermore, the pump housing 4 has a stator-side (tubular) housing connector 17 connected to the stator 1, and the stator-side coupling or rotor-side coupling 12 is for example inside this stator-side housing connector 17. In this regard, only the drive-side housing connector 16 is shown in FIGS. 2 to 7. The stator-side housing connector 17 is not shown in FIGS. 2 to 7.

According to the invention, the drive-side housing connector 16 can be disassembled or dismantled in such a manner that the drive-side coupling 11 can be exposed for the purpose of maintenance and/or disassembly. This is evident from a comparative consideration of FIGS. 2 to 7 and, in particular, from FIGS. 2 and 3. In this regard, it can be seen in the drawing that in this embodiment the drive-side coupling 11 is fully exposed by disassembly of the drive-side housing connector 16, i.e. the coupling is no longer surrounded by the housing connector 16 and is fully exposed in this region. The entire length of the coupling is normally exposed, but at least in the coupling region or in the plane of the coupling.

Figure 2:
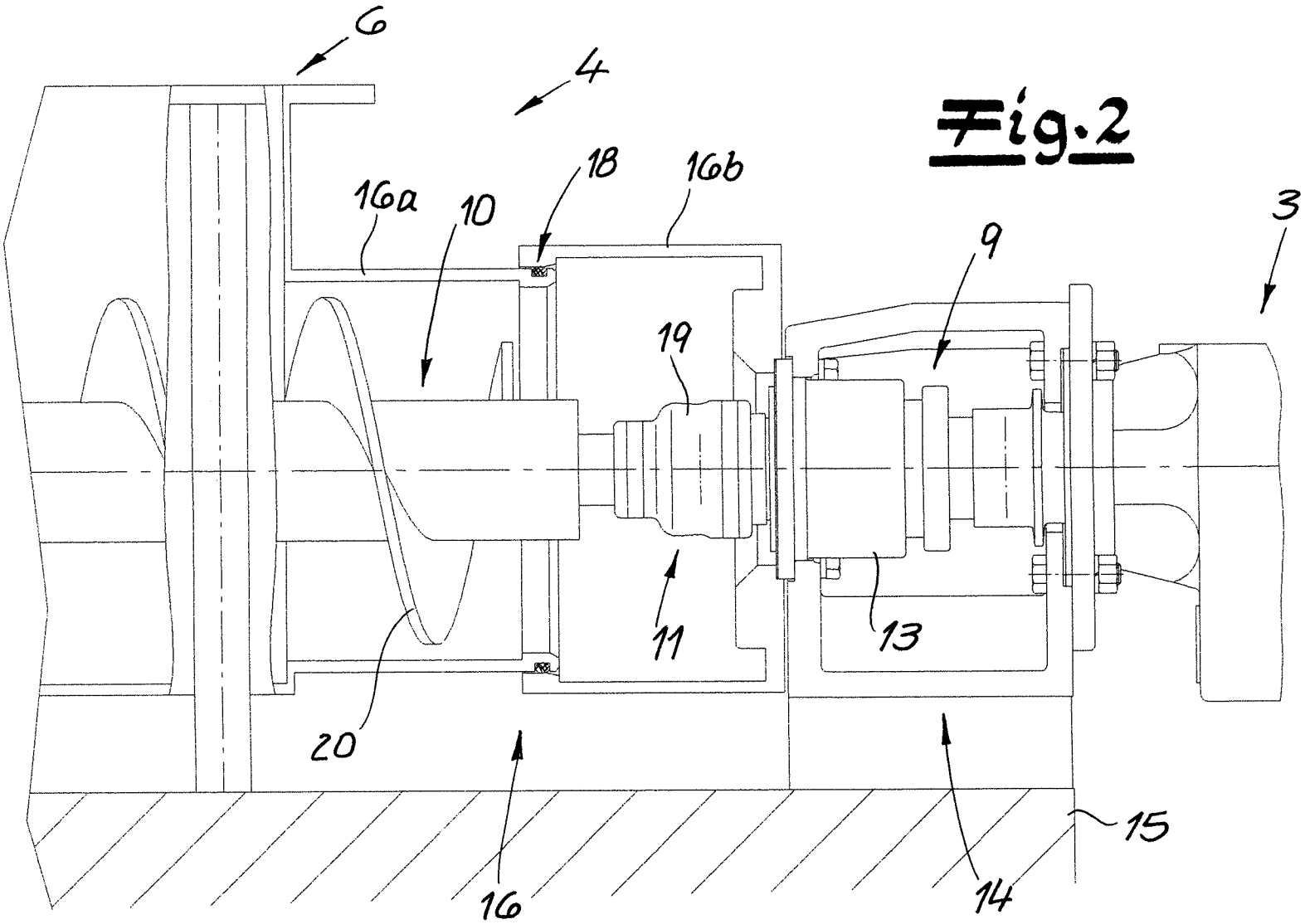
FIGS. 2 to 7 show a detail from the object according to FIG. 1, in different disassembly positions, (FIGS. 2 to 5 in side view/partial section, FIGS. 6 and 7 in top view/partial section)
Figure 3:
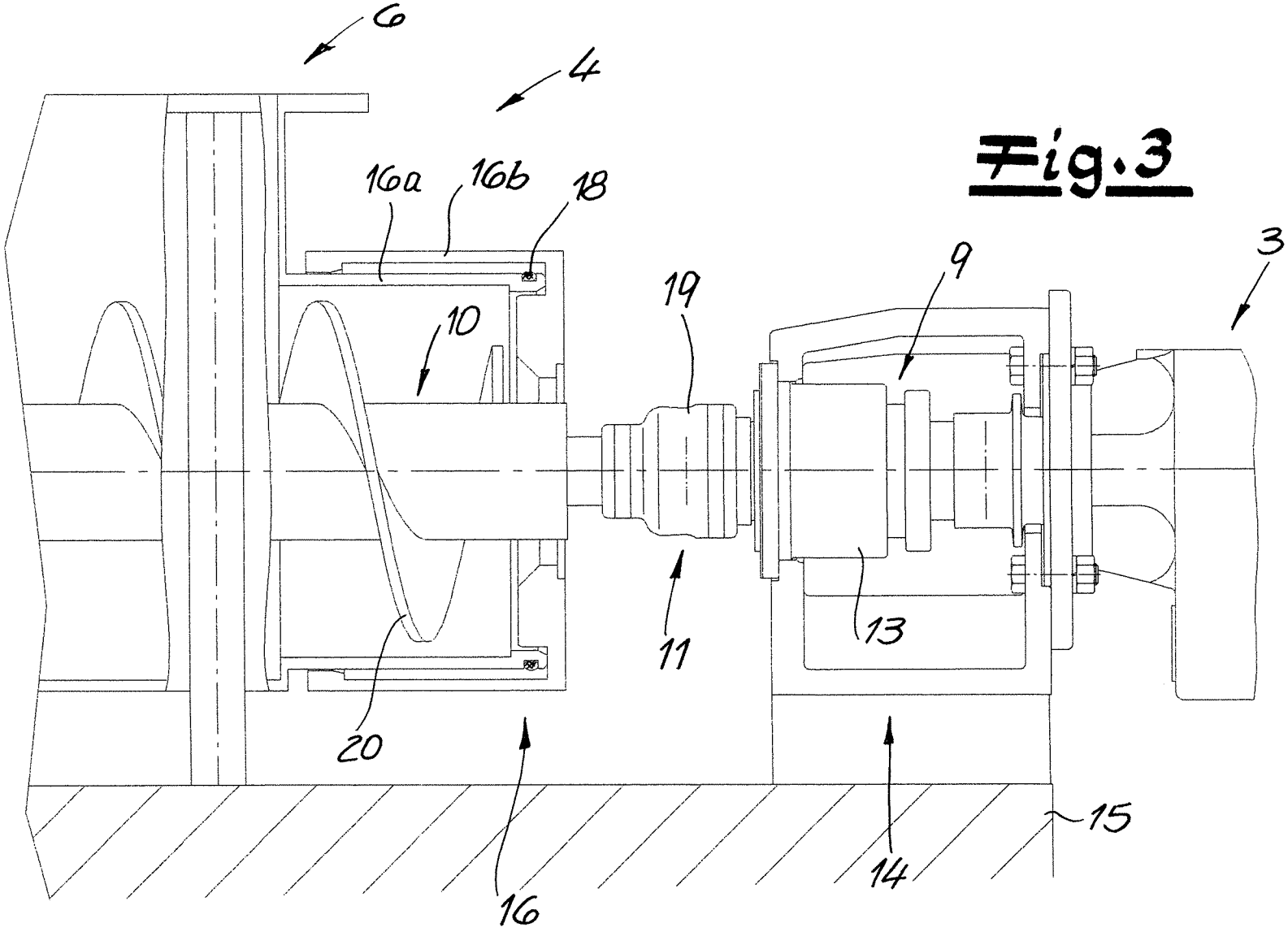

In this regard, the drive-side housing connector 16 consists of a first, fixed connection-piece section 16*a* and a second displaceable connection-piece section 16*b*. The second section 16*b* is axially displaceable in the illustrated embodiment. Comparison FIGS. 2 and 3 shows that the region of the drive-side coupling 11 is exposed by axial displacement of the second section 16*b*, and consequently becomes accessible. In the embodiment shown, displacement of the second section takes place axially in the direction toward the first section 16*a* and consequently toward the intake port 6 or of the funnel of the pump housing 4.

In this regard, it can be seen that at least one seal 18 is provided between the first section 16*a* and the second section 16*b* and seals off the first section 16*a* relative to the second section 16*b* in liquid-tight and pressure-tight manner, specifically in the assembled state shown in FIG. 2. In this embodiment, the seal 18 is attached to the first section 16*a* on its outer surface (for example in a groove). Alternatively, however, such a seal can also be provided on the second section 16*b* on its inner surface.

In any case, according to this first aspect of the invention, the drive-side coupling is exposed for the purpose of maintenance and/or disassembly.

Figure 4:
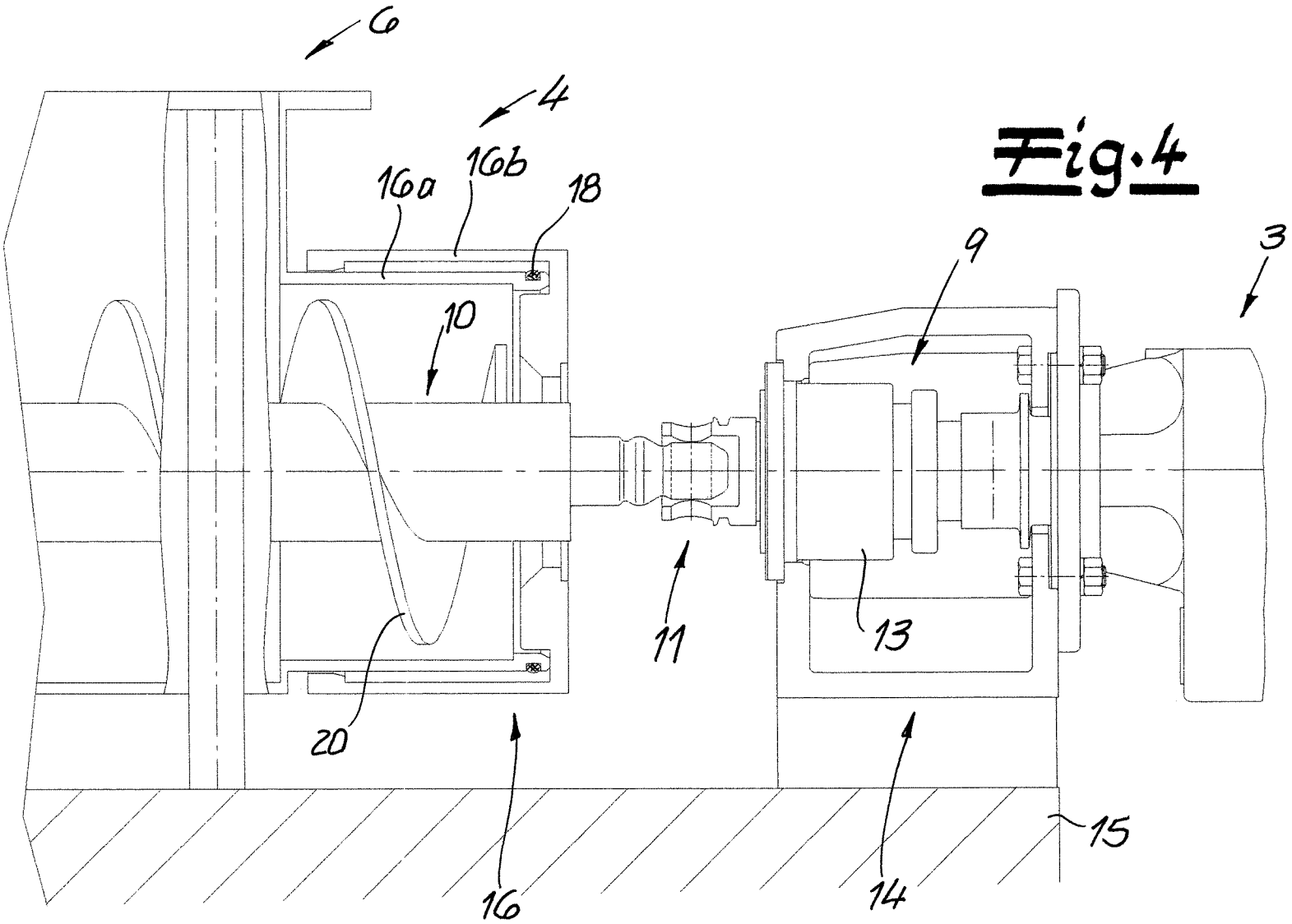
Figure 5:
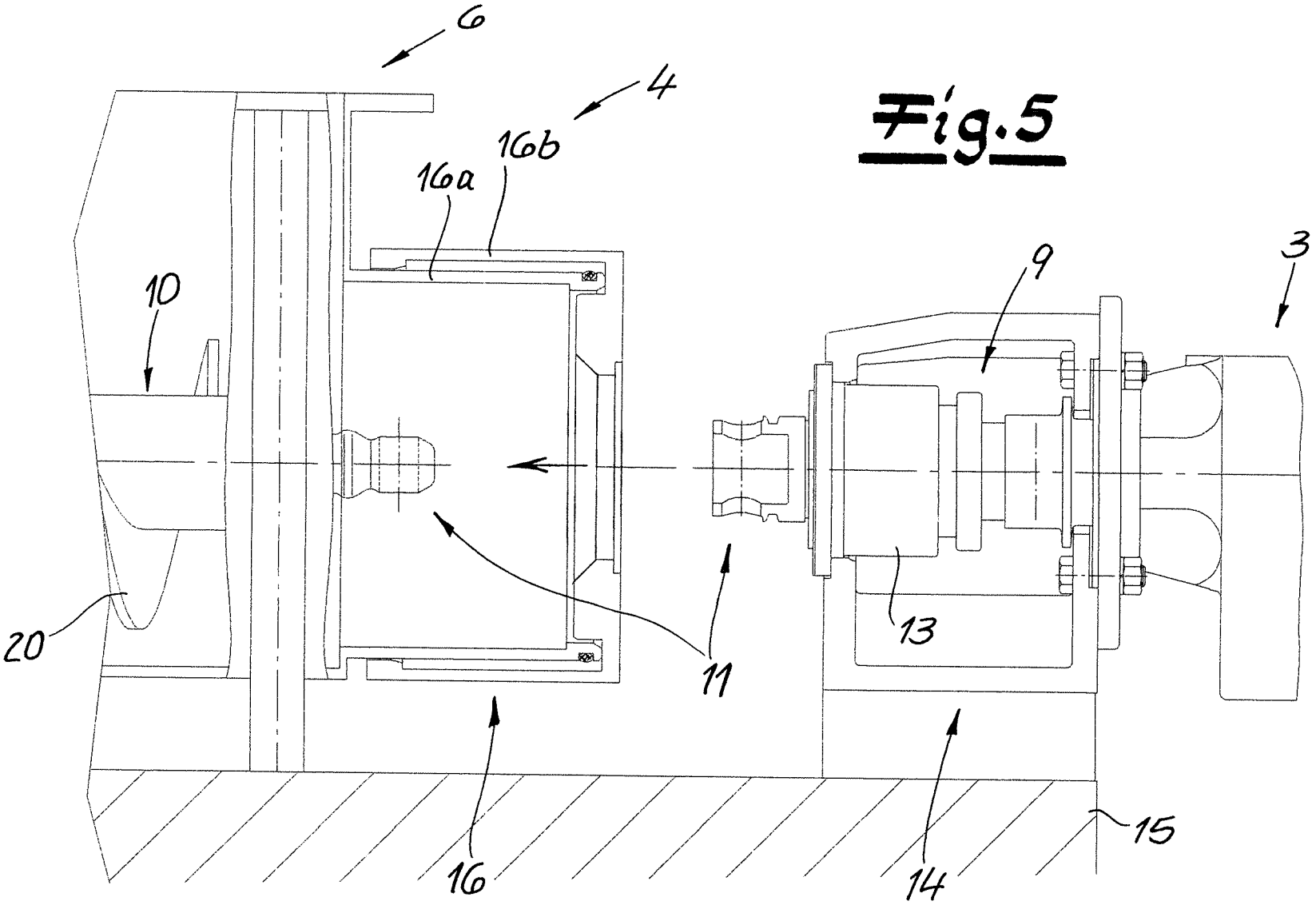

After the second section 16*b* has been pushed onto the first section 16*a* (FIG. 3), the cuff 19 of the drive-side coupling 11 can subsequently be removed, and the coupling can be dismantled (see FIG. 4). Subsequently, the coupling rod 10 (together with the rotor 2 connected with it) can be pushed away or pulled out from the drive side (see FIG. 5).

Figure 6:
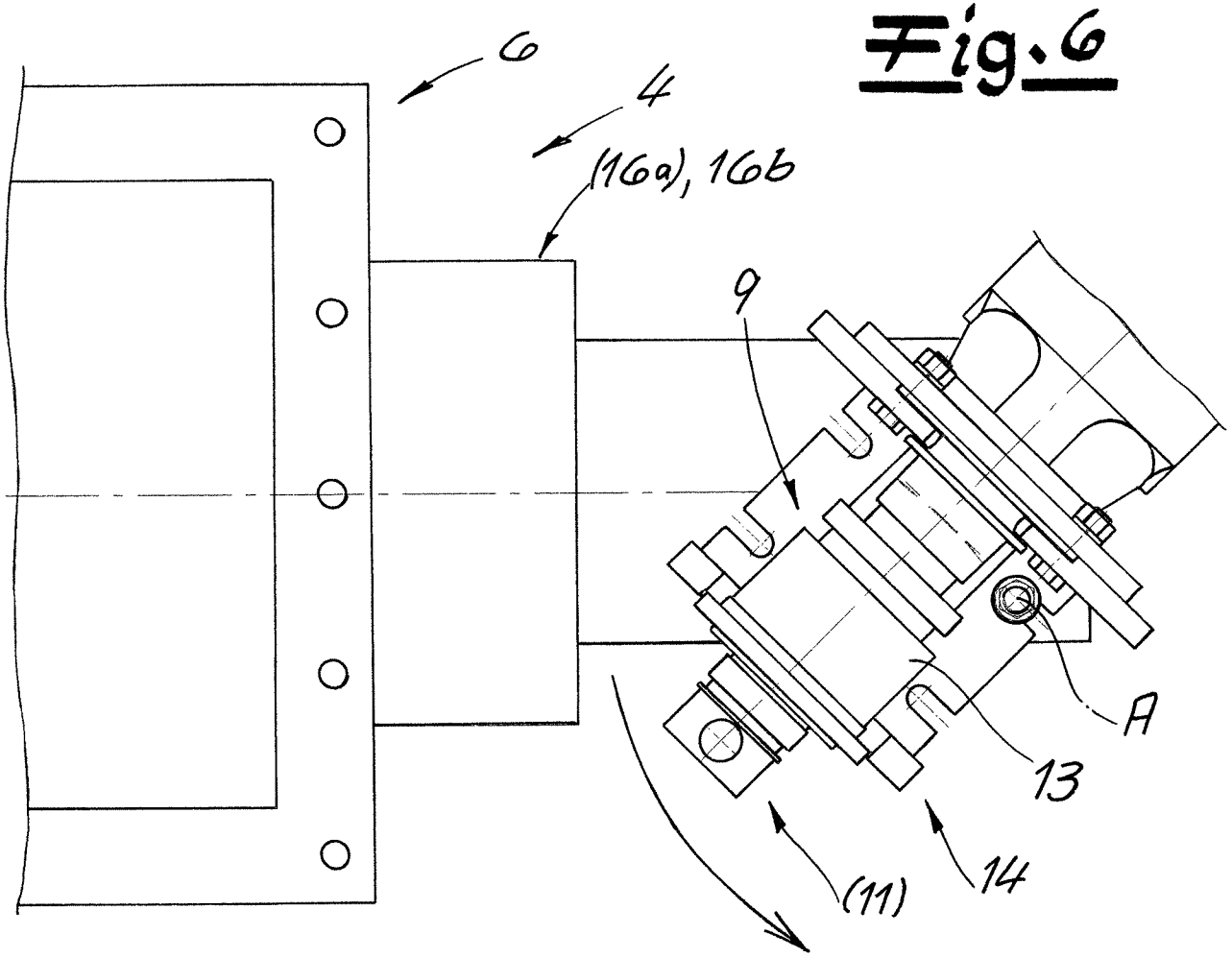

In a particularly advantageous further development, the possibility now exists as shown in FIG. 6 of pivoting the drive-connection housing 14 about a vertical axis of rotation A (see FIG. 6), specifically without the pump housing 4 itself having to be removed. This is because corresponding free space occurs as the result of pushing the second section 16*b* back, so that the drive-connection housing 14 is pivotal in the manner shown. In this regard, the position of the vertical axis A is relative to the base 15 or a corresponding foundation. Basically, however, the possibility also exists of installing such a pump in a different orientation. If installation takes place in the vertical direction, for example, then the base plate is vertical, so that the drive-connection housing 14 is then pivoted about a horizontal axis, but this axis then also stands perpendicular to the base plate or the corresponding reference plane.

Figure 7:
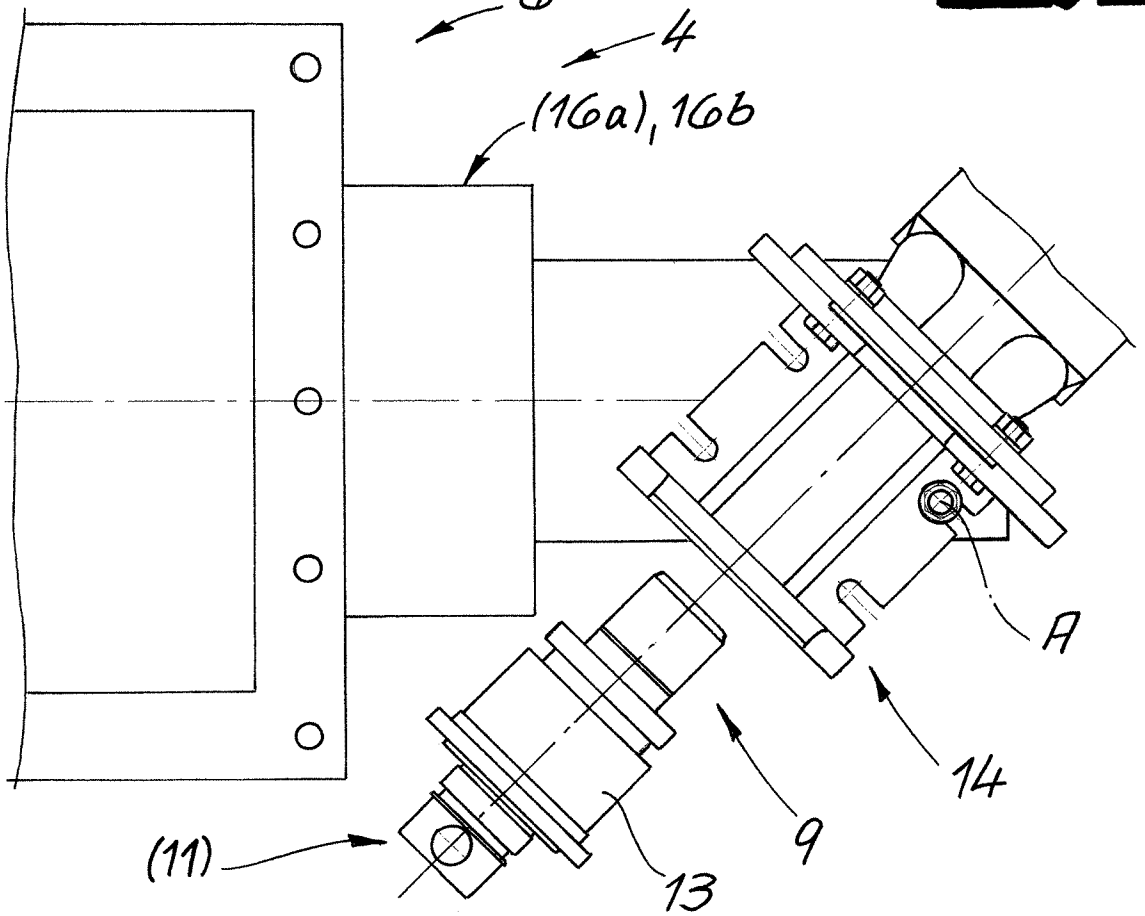

According to FIG. 7, the drive shaft 9, which is a stub shaft, can be pulled out of the drive-connection housing 14 after pivoting takes place. This is interesting because the stub shaft is a wear-prone part that must be replaced at regular intervals. According to the invention, this replacement can now take place without the drive 3 and the pump housing 4 having to be removed. Instead, it is sufficient to merely open or disassemble the pump housing 4 on the drive side, in the manner described, and subsequently to pivot the drive-connection housing 14 in the manner described. Alternatively or in addition the shaft seal, for example the slide ring seal 13, can also be replaced.

In this regard, FIGS. 6 and 7 show the pump in a top view, while FIGS. 2 to 5 show the pump in a side view and in vertical section. In this regard, it can be seen in FIGS. 6 and 7 that the lantern or drive-connection housing 14 can be attached to the base plate with fasteners, for example four screws. For pivoting, three of these screws can now be removed, and the remaining screw can be correspondingly released or loosened, so that the drive-connection housing 14 can then be pivoted about the axis A formed by this screw. In this regard, concepts known from the state of the art can basically be used for attachment of the lantern, and nevertheless pivotability is made possible within the scope of the invention, without the pump housing 4 having to be removed (completely).

FIGS. 8 to 12 show alternative embodiments of the invention where characteristics implemented in the different embodiments can be implemented, in different combinations, also in the embodiment according to FIGS. 1 to 7. In this regard, the important thing in the embodiments shown in FIGS. 8 to 12 is that the coupling rod 10 is supported to prevent dropping and/or to prevent (axial) displacement during opening-up of the drive-side housing connector 16, so that before the drive-side coupling 11 is released, fixation of the coupling rod 10 for service purposes becomes possible before release of the drive-side coupling 11, so that in particular, disassembly of the coupling 11 is facilitated.

Figure 8:
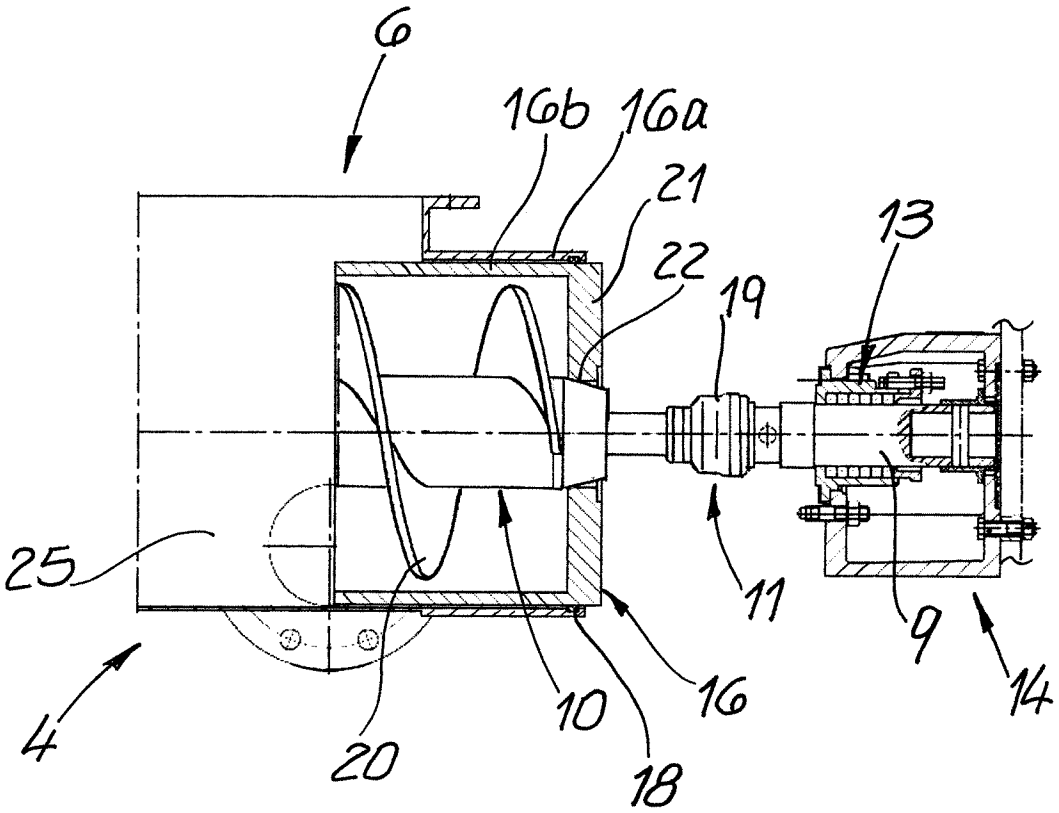
FIG. 8 is a view like FIG. 3 of a second embodiment of the invention in a functional position.

In this regard, FIG. 8 shows an embodiment in which the second movable section 16*b* is provided with a connection-piece end wall 21 that has a (central) hole 22. In the assembled state, the drive shaft 9 passes through this hole 22. During disassembly, the displaceable second connector 16*b* is displaced toward the fixed first section 16*a*, and in the displaced position the coupling rod 10 is supported by this connector wall 21 and fits into the hole 22, so that the coupling rod 10 does not drop even after separation of the coupling 11. At the same time, sealing of the interior 25 of the pump housing by the coupling rod 10 that engages into the hole 22 takes place, but without a special seal being provided in the region of the hole 22 in the embodiment according to FIG. 8. Furthermore, FIG. 8 shows an embodiment in which the housing connector 16*b* does not telescope outside the housing connector 16*a*, but telescopes inside the housing connector 16*a*. However, the support shown in FIG. 8 can also be implemented in the same manner as in the case of the embodiment shown in FIGS. 1 to 7.

Figure 9:
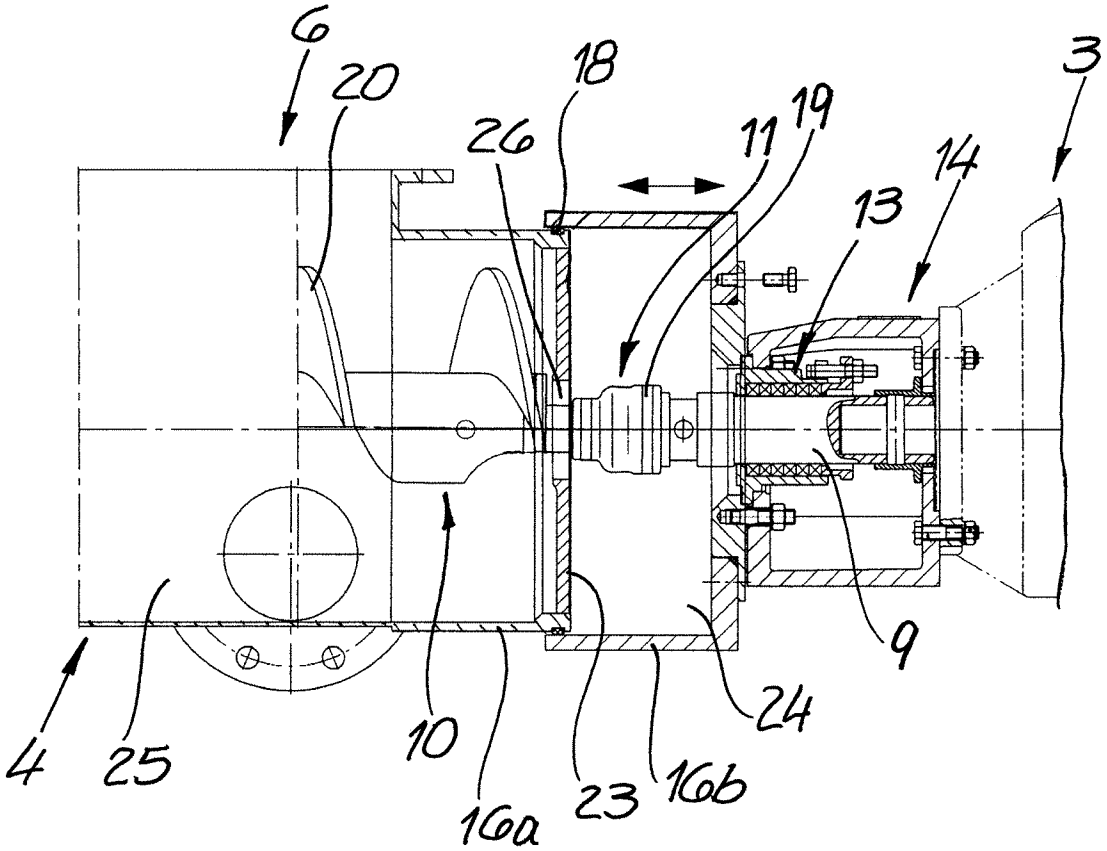
FIG. 9 is a view of a third embodiment of the invention (in a functional position corresponding to FIG. 2)

FIG. 9 shows a modified embodiment in which support of the coupling rod 10 during disassembly is implemented not by a connection-piece end wall on the displaceable section 16*b*, but rather by an (additional) partition wall 23 provided in the drive-side housing connector 16. This partition wall 23 can be on the end-face end of for example the fixed section 16*a*. The partition wall 23 is also provided with a hole 26 through which the coupling rod 10 fits, so that the coupling rod 10 is supported in the hole 26 at least during disassembly of the drive-side housing connector 16. In such an embodiment, the partition wall 23 divides a drive-side chamber 24 (formed for example by the displaceable connector part 16*b*) from the interior of the pump housing.

Figure 10:
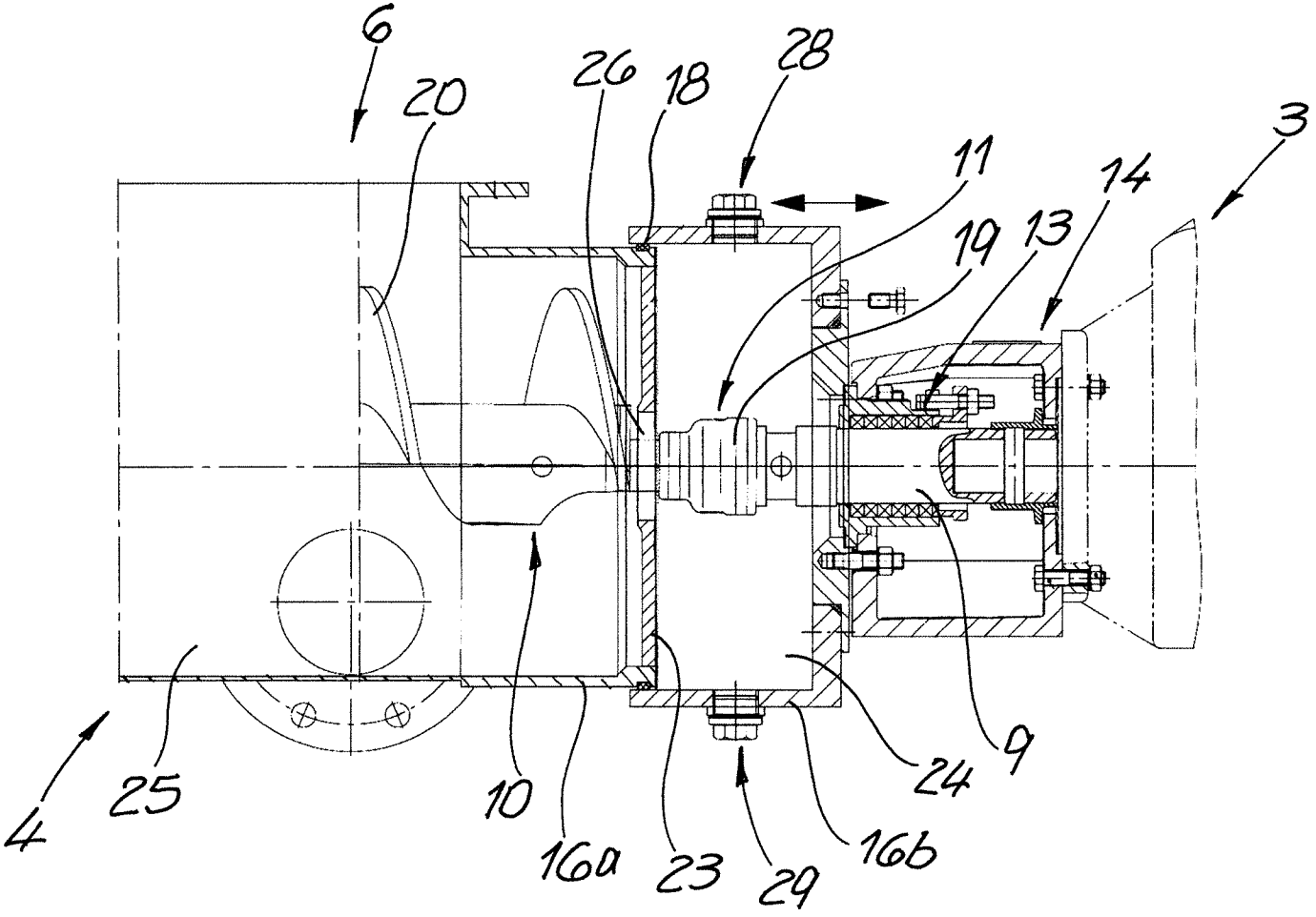
FIG. 10 shows a fourth embodiment of the invention.

The embodiment according to FIG. 10 essentially corresponds to the embodiment according to FIG. 9. In addition, however, here flush fittings 28, 29 are provided in the region of the second section, so that for example the drive-side chamber 24 formed by the second section 16*b* is provided with these flush fittings 28, 29. In this manner, the space around the (exposed) coupling 11 can then be cleaned without cleaning liquid getting into an interior 25 of the pump housing.

Figure 11:
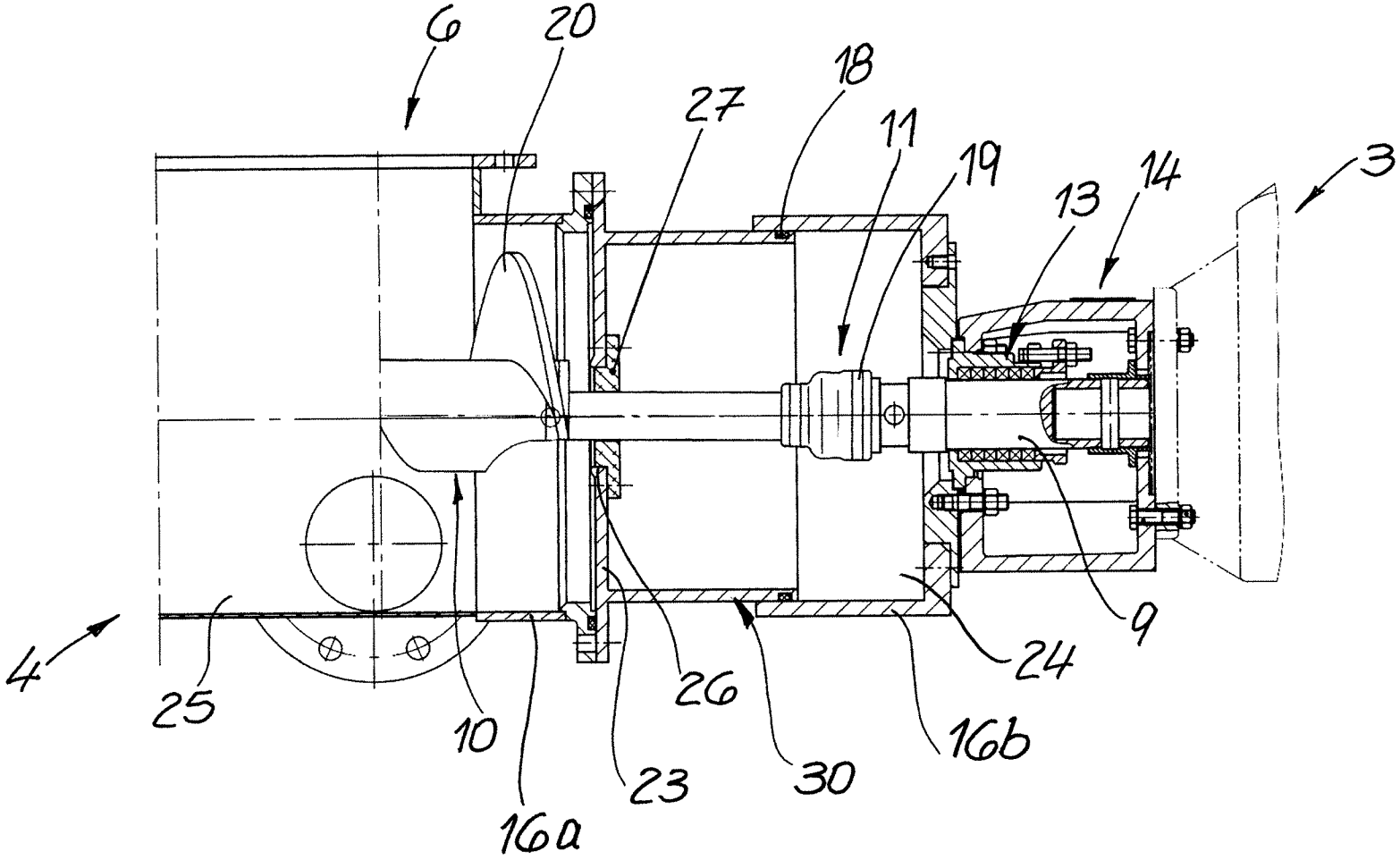
FIG. 11 shows a fifth embodiment of the invention.

Proceeding from the embodiments shown in FIGS. 9 and 10, FIG. 11 shows a modification in which the coupling rod 10 is supported in the hole 26 with the interposition of a seal 27. Furthermore, a further modification can be seen in FIG. 11, because there the partition wall 23 is not provided at the end-face end of the fixed section 16*a*, but rather is an additional component 30 that extends the first section 16*a*, so that the second section 16*b* can be pushed onto this additional extension component 30. The partition wall 23 is a component of this additional connector component 30.

Figure 12:
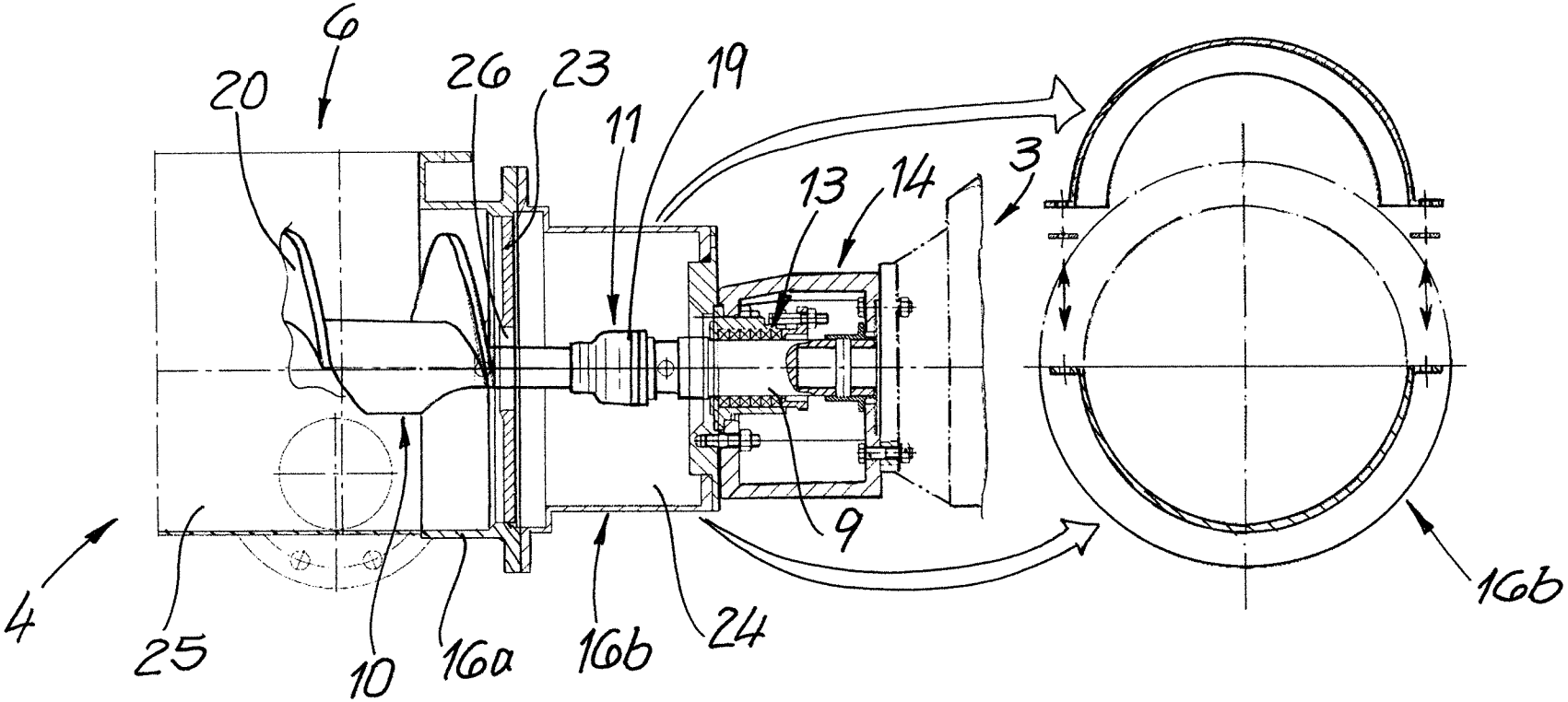
FIG. 12 shows a sixth embodiment of the invention.

Finally, FIG. 12 shows a modified embodiment, in which disassembly is implemented not by axial displacement, but rather by a half-shell solution. Once again, a fixed first section 16*a* is provided, and the second section 16*b* is formed by partial shells, for example two half-shells, in this case. For disassembly, at least one of the half-shells can be removed, so that the coupling 11 is exposed. In this embodiment, as well, a partition wall 23 is provided that has a hole 26 for supporting the coupling rod.

In the embodiments shown, dismantling corresponding couplings 11, 12 takes place during disassembly, so that for example for separation of the rotor 2 from the coupling rod 15, the coupling 12 itself is dismantled. However, it also lies within the scope of the invention to provide separation points or separation elements in addition to the couplings 11, 12, so that separation of the respective parts is possible without dismantling the couplings. For this purpose, it is possible to use models from the state of the art, which are not shown in the drawing.

The invention claimed is:

1. An eccentric screw pump comprising:

a stator, a rotor rotatable in the stator about an axis, a drive for rotating the rotor about the axis, a pump housing connected with the stator and having a port serving for intake or output of a medium to be conveyed, a drive-connection housing provided between the pump housing and the drive, a drive shaft connected with the drive and in the drive-connection housing, a drive-side coupling connected to the drive shaft of the drive, a rotor-side coupling connected to the rotor, a coupling rod in the pump housing and connected with the drive shaft by the drive-side coupling and with the rotor by the rotor-side coupling, a drive-side housing connector connected between the pump housing and the drive-connection housing, surrounding the drive-side coupling, and having a section that is fixed and a movable section that is telescopically and axially displaceable toward the port of the pump housing and relative to the fixed section into a disassembly position with the movable section axially displaced onto or into the fixed section to fully expose the drive-side coupling for maintenance or disassembly and axially away from the port from the disassembly position into a functional position surrounding and protecting the drive-side coupling, and a stator-side housing connector attached to the stator and supporting the coupling rod in the disassembly position of the movable section.

2. The eccentric screw pump according to claim 1, wherein in the functional position the drive-side coupling is surrounded by the drive-side housing connector all around the drive-side housing connector.

3. The eccentric screw pump according to claim 1, wherein in the disassembly position the drive-connection housing is pivotal about a vertical axis of rotation relative to a base plane of the eccentric screw pump.

4. The eccentric screw pump according to claim 1, wherein the intake port is formed by an inflow funnel.

5. The eccentric screw pump according to claim 1, wherein the coupling rod is provided with an auger attached to an outer surface of the coupling rod.

6. The eccentric screw pump according to claim 1, wherein the movable section is sealed relative to the fixed section with at least one seal.

7. The eccentric screw pump according to claim 1, wherein a partition wall is provided in the drive-side housing connector and separates a drive-side chamber from an interior of the pump housing, the partition wall having a hole through which the coupling rod passes.

8. The eccentric screw pump according to claim 7, wherein the coupling rod is supported at the hole at least in the disassembly position of the drive-side housing connector.

9. The eccentric screw pump according to claim 7, wherein the partition wall is provided in the fixed section of the drive-side housing connector.

10. The eccentric screw pump according to claim 7, further comprising a seal in the hole supporting the coupling rod at least in the disassembly position.

11. The eccentric screw pump according to claim 1, wherein the movable section is provided with one or more multiple flush fittings.

12. The eccentric screw pump defined in claim 1, wherein the fixed section and the movable section of the drive-side housing connector are cylindrically tubular.

13. An eccentric screw pump comprising:

a stator;

a rotor rotatable in the stator about an axis;

a drive for rotating the rotor about the axis;

a pump housing connected with the stator and having at least one port for intake or output of a medium to be conveyed;

a drive-connection housing provided between the pump housing and the drive;

a drive shaft connected with the drive and in the drive-connection housing;

a drive-side coupling connected to the drive shaft of the drive;

a rotor-side coupling connected to the rotor;

a coupling rod in the pump housing and connected with the drive shaft by the drive-side coupling and with the rotor by the rotor-side coupling;

a drive-side housing connector connected between the pump housing and the drive-connection housing, surrounding the drive-side coupling, and having a section that is fixed and a movable section that is telescopically and axially displaceable toward the at least one port of the pump housing into a disassembly position with the moveable section axially in or on the fixed section to fully expose the drive-side coupling and axially away from the at least one port from the disassembly position into a functional position surrounding and protecting the drive-side coupling;

a stator-side housing connector connected to the stator and the at least one port being between the drive-side housing connector and the stator-side housing connector; and a support engaged to the coupling rod to support the coupling rod in the disassembly position of the drive-side housing connector.

14. The eccentric screw pump defined in claim 13, wherein the support is part of the drive-side housing connector.

* * * * *